US012553134B2

(12) United States Patent
Iyer et al.

(10) Patent No.: US 12,553,134 B2
(45) Date of Patent: Feb. 17, 2026

(54) BENDABLE NICKEL PLATING ON FLEXIBLE SUBSTRATES

(71) Applicant: MacDermid Enthone Inc., Waterbury, CT (US)

(72) Inventors: Aparna Iyer, Unionville, CT (US); Ernest Long, Burlington, CT (US); Kishore Viswanathan, Unionville, CT (US)

(73) Assignee: MacDermid Enthone Inc., Waterbury, CT (US)

( * ) Notice: Subject to any disclaimer, the term of this patent is extended or adjusted under 35 U.S.C. 154(b) by 0 days.

(21) Appl. No.: 18/374,804

(22) Filed: Sep. 29, 2023

(65) Prior Publication Data

US 2025/0109499 A1 Apr. 3, 2025

(51) Int. Cl.

| | |
|---|---|
| ***C23C 18/00*** | (2006.01) |
| ***C23C 18/16*** | (2006.01) |
| ***C23C 18/18*** | (2006.01) |
| ***C23C 18/36*** | (2006.01) |

(52) U.S. Cl.

CPC ..... *C23C 18/36* (2013.01); *C23C 18/1637* (2013.01); *C23C 18/1641* (2013.01); *C23C 18/1651* (2013.01); *C23C 18/1879* (2013.01)

(58) Field of Classification Search

CPC . C23C 18/26; C23C 18/1637; C23C 18/1641; C23C 16/1651; C23C 18/1879

USPC ..... 106/1.22

See application file for complete search history.

(56) References Cited

U.S. PATENT DOCUMENTS

| | | | | |
|---|---|---|---|---|
| 3,856,638 | A * | 12/1974 | Bick | C25D 3/62 205/268 |
| 10,358,724 | B2 | 7/2019 | Lee et al. | |
| 2003/0232148 | A1* | 12/2003 | Shahin | C23C 18/36 427/443.1 |
| 2004/0144285 | A1 | 7/2004 | Stark et al. | |
| 2006/0083850 | A1 | 4/2006 | Valverde et al. | |
| 2006/0225605 | A1 | 10/2006 | Kloeckener et al. | |
| 2007/0104929 | A1 | 5/2007 | Yim et al. | |
| 2010/0155108 | A1 | 6/2010 | Lee et al. | |
| 2010/0183898 | A1 | 7/2010 | Imai et al. | |
| 2010/0189974 | A1 | 7/2010 | Ochi et al. | |
| 2011/0051387 | A1 | 3/2011 | Tachibana et al. | |
| 2012/0058259 | A1* | 3/2012 | Nye | C23C 18/50 427/132 |

(Continued)

FOREIGN PATENT DOCUMENTS

| | | | |
|---|---|---|---|
| CN | 102268658 | A | 12/2011 |
| CN | 104561951 | A | 4/2015 |

(Continued)

*Primary Examiner* — James E McDonough

(74) *Attorney, Agent, or Firm* — Carmody Torrance Sandak & Hennessey LLP

(57) ABSTRACT

A method of producing a flexible nickel phosphorus plating layer on a substrate. The substrate comprises a dielectric material with a copper layer thereon. The method includes the steps of (1) activating the substrate with a palladium activation solution to catalyze the substrate, and (2) contacting the activated substrate with an electroless nickel phosphorus plating solution comprising (i) a source of nickel ions; (ii) a source of hypophosphite ions; (iii) at least one complexing agent; and (iv) an organic flex additive. The nickel phosphorus plating layer deposited on the substrate exhibits a columnar grain structure.

23 Claims, 4 Drawing Sheets

(56) References Cited

U.S. PATENT DOCUMENTS

| | | | |
|---|---|---|---|
| 2014/0178571 | A1 | 6/2014 | Bamba et al. |
| 2015/0009638 | A1 | 1/2015 | Janssen |
| 2016/0168718 | A1 | 6/2016 | Lee et al. |
| 2018/0258538 | A1 | 9/2018 | Thottathil et al. |
| 2018/0298496 | A1 | 10/2018 | Smith et al. |
| 2020/0048773 | A1 | 2/2020 | Kato et al. |
| 2020/0123660 | A1 | 4/2020 | Kato et al. |
| 2020/0205298 | A1 | 6/2020 | Kurosaka et al. |
| 2021/0140050 | A1 | 5/2021 | Derderian |

FOREIGN PATENT DOCUMENTS

| | | | | |
|---|---|---|---|---|
| CN | 105018904 | A | | 11/2015 |
| CN | 108342717 | A | | 7/2018 |
| CN | 108546937 | A | | 9/2018 |
| CN | 109357805 | A | | 2/2019 |
| CN | 110983309 | A | | 4/2020 |
| CN | 111763932 | A | | 10/2020 |
| CN | 112368416 | A | | 2/2021 |
| CN | 11505885 | A | | 9/2022 |
| CN | 114990534 | A | | 9/2022 |
| CN | 115023059 | B | | 10/2022 |
| DE | 0573918 | A1 | * | 12/1993 |
| EP | 3190209 | A1 | | 7/2017 |
| JP | 2000232269 | A | | 8/2000 |
| JP | 2005060772 | A | | 3/2005 |
| JP | 2005126734 | A | | 5/2005 |
| JP | 2006104504 | A | | 4/2006 |
| JP | 2006206985 | A | | 8/2006 |
| JP | 2007009305 | A | | 1/2007 |
| JP | 2008274444 | A | | 11/2008 |
| JP | 2009173999 | A | | 8/2009 |
| JP | 2009192922 | A | | 8/2009 |
| JP | 2011014801 | A | | 1/2011 |
| JP | 2011517112 | A | * | 5/2011 |
| JP | 2013019044 | A | | 1/2013 |
| JP | 2013028866 | A | | 2/2013 |
| JP | 2013166998 | A | | 8/2013 |
| JP | 5344416 | B2 | | 11/2013 |
| JP | 2015030885 | A | | 2/2015 |
| JP | 2015201658 | A | | 11/2015 |
| JP | 2016191842 | A | | 11/2016 |
| JP | 2017031436 | A | | 2/2017 |
| JP | 2018035389 | A | | 3/2018 |
| JP | 2019007047 | A | | 1/2019 |
| JP | 2019119901 | A | | 7/2019 |
| JP | 2019199628 | A | | 11/2019 |
| JP | 2020084255 | A | | 6/2020 |
| JP | 7157435 | B2 | | 10/2022 |
| KR | 20080066581 | A | | 7/2008 |
| KR | 20110083586 | A | | 7/2011 |
| KR | 20140025105 | A | | 3/2014 |
| KR | 20210089695 | A | | 7/2021 |
| TW | I778355 | B | | 9/2022 |
| TW | 202241221 | A | | 10/2022 |
| WO | 2019087474 | A1 | | 5/2019 |
| WO | 2020094642 | A1 | | 5/2020 |
| WO | 2021145300 | A1 | | 7/2021 |
| WO | 2022145764 | A1 | | 7/2022 |

* cited by examiner

- Smaller grains.
- Columnar deposit growth.

BENDABLE NICKEL PLATING ON FLEXIBLE SUBSTRATES

FIELD OF THE INVENTION

The present invention relates generally to a method of plating a bendable nickel alloy on a flexible substrate and compositions for use therein.

BACKGROUND OF THE INVENTION

Nickel-phosphorous alloys layers deposited by electroless plating are frequently used as a barrier layer between a copper surface and a solderable or wire bondable material such as a palladium and/or gold layer in the manufacture of printed circuit boards, IC substrates and other similar substrates. The barrier layer prevents and/or inhibits diffusion between the copper surface of a copper circuitry or a copper contact area of the substrate and a noble metal layer and provides corrosion protection for the copper surface.

Electroless deposition of nickel-phosphorous alloys onto rigid substrates is well known in the art. However, more recently, it has also been desirable to deposit nickel-phosphorus alloy layers as barrier layers on flexible substrates, such as in the manufacture of flexible printed circuit boards. These materials may be used in products such as medical equipment, keyboards, hard disk drives, printers, and cellular phones. The flexible substrates may comprise a dielectric base polymer material with a copper circuitry attached thereon. Parts of the copper circuitry designated as contact areas must be coated with a nickel-phosphorous alloy layer to serve as a barrier layer between the copper circuitry and noble metal layers (i.e., palladium and/or gold layers) deposited onto the barrier layer. The bendability of the nickel-phosphorous alloy layer is essential for reliability of the flexible printed circuit board or related devices.

The flexible dielectric base material may be made of polymer materials such as polyimide, fluoropolymers (e.g., Teflon®), epoxy-based composites or polyester such as polyethylene terephthalate (PET). The copper circuitry may be formed by etching the desired circuitry pattern in a copper layer attached to the base material foil.

Selected areas of the copper circuitry can then be connected with other components by methods such as soldering or wire bonding. Based thereon, these selected areas must be prepared, such as by a) depositing a nickel-phosphorous alloy layer by electroless plating as a barrier layer thereon; and/or b) depositing one or more noble metal layers, e.g., a palladium layer, a gold layer or a multilayer consisting of a palladium layer and a gold layer onto the barrier layer in order to provide a solderable and/or wire bondable surface on the areas of the copper circuitry designated for connecting with other components.

Conventional electroless plating baths used to deposit nickel-phosphorous alloys on rigid substrates generally lead to nickel-phosphorous alloy layers which are prone to undesired crack formation when bending the coated flexible substrate; the nickel-phosphorus alloy is prone to cracking due to its lamellar microstructure.

It is known in the art that the addition of various additives such as amines, diamines, cyans, formaldehyde and bismuth to an electroless nickel-phosphorus plating bath can change the structure of the nickel-phosphorus alloy from lamellar to columnar. However, many of these additives are toxic and require special working conditions with respect to the health and safety of the operator.

U.S. Pat. Pub. No. 2015/0009638 to Janssen, the subject matter of which is herein incorporated by reference in its entirety describes a method for electroless deposition of a bendable nickel-phosphorus alloy layer onto flexible substrates such as flexible printed circuit boards and the like and in which the nickel-phosphorus alloy layers have a columnar microstructure oriented perpendicular to the flexible substrate and that is sufficiently bendable. The electroless nickel-phosphorus composition includes a grain refining agent as an additive that is selected from formaldehyde and formaldehyde precursors such as acetales, hemiacetales, aminales and N,O-acetales. However, formaldehyde is highly toxic and the vapor is a severe respiratory and skin irritant.

U.S. Pat. Pub. No. 2010/0155108 to Lee et al., the subject matter of which is herein incorporated by reference in its entirety, describes an electroless nickel plating solution composition that includes a vertical growth inducer that may include a compound having bismuth ions, such as bismuth sulfate, bismuth nitrate, or the like, which has been found to play a role in changing orientation of crystal growth of nickel so that nickel can be grown to have a vertical structure with respect to the plated surface. However, many of these bismuth compounds can be toxic under the bath conditions of the electroless nickel plating bath.

JP2006-206985 describes a plating bath for the deposition of nickel-phosphorus alloys comprising nickel ions, hypophosphite ions and an aminocarboxylic acid to obtain nickel-phosphorus layers that are bendable for use on flexible substrates. However, in this bath, it is essential that the composition be free of carboxylic acids that do not have an amino residue because otherwise no bendable nickel-phosphorus alloy layer can be deposited from the bath.

JP5344416B2 describes a plating bath for electroless nickel deposition that includes an additive to improve bendability that is an alkylene diamine compound represented by the structure:

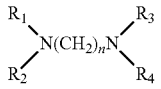

In the formula, $R^1$, $R^2$, $R^3$ and $R^4$ are the same or different, and each is a hydrogen atom or the following group —$(R^5O)_mH$, wherein $R^5$ is a linear or branched alkylene group having to 1 to 5 carbon atoms, m is an integer between 1 and 10 and n is 2 or 3.

U.S. Pat. No. 10,358,724 to Lee et al., the subject matter if which is herein incorporated by reference in its entirety, describes an electroless nickel plating solution that contains a cyan-based stabilizer such as sodium thiocyanate, sodium cyanide or potassium cyanide. However, cyan-based stabilizers can be toxic under the bath conditions of the electroless nickel plating bath.

By transforming the microstructure of the nickel-phosphorus alloy layer from lamellar to columnar through the use of various additives and bath conditions, instantaneous cracking can be effectively prevented. With a columnar microstructure, the cracking pattern is distributed throughout entire microstructure and therefore single point and/or single line failure does not occur. Therefore, the plated substrate itself is bendable many times over before final cracking of the copper substrate itself. In other words, the columnar structure allows for the formation of microcracks which prevents cracks from penetrating down to the copper circuitry layer.

While prior art bath compositions have been developed that are capable of producing a bendable nickel-phosphorus plating layer on a flexible substrate, it would be desirable to provide an electroless nickel plating baths that is capable of producing a columnar grain structure and that is non-volatile and easy to handle (i.e., less toxic or hazardous to the workers) while the bath is in operation, inexpensive, and that can be incorporated into a standard electroless nickel-phosphorus plating process.

SUMMARY OF THE INVENTION

It is an object of the present invention to achieve microstructural transformation in the growth of nickel-phosphorus alloys plated on copper substrates.

It is another object of the present invention to produce an electroless nickel phosphorus alloy deposit on a substrate that exhibits a columnar microstructure.

It is another object of the present invention to provide an electroless nickel phosphorus plating bath that contains a flex additive for producing a bendable nickel phosphorus layer.

It is another object of the present invention to provide an electroless nickel phosphorus plating bath that contains a flex additive that is non-volatile and easy to hand and that does not require any special working conditions.

It is another object of the present invention to provide an electroless nickel phosphorus plating bath containing a flex additive that is stable up to 6 MTO.

If it is another object of the present invention to provide a bendable nickel phosphorus plating layer on a flexible substrate.

It is still another object of the present invention to provide a bendable nickel phosphorus plating layer on a dielectric substrate that includes copper circuitry disposed thereon.

To that end, in one embodiment, the present invention relates generally to an aqueous electroless nickel-phosphorus bath composition comprising:

a) a source of nickel ions;
b) a source of hypophosphite ions;
c) at least one complexing agent;
d) a flex additive, wherein the flex additive comprises a guanidine derivative;
e) optionally, a pH adjuster;
f) optionally, a bath stabilizer; and
g) optionally, a source of lead ions.

The present invention also relates generally to a method of producing a flexible nickel phosphorus plating layer on a substrate, wherein the substrate comprises a dielectric substrate with copper plating thereon, the method comprising the steps of:

a. activating the substrate with a palladium activation solution to catalyze the substrate, and, thereafter.
b. contacting the activated substrate with an electroless nickel phosphorus plating solution comprising:
   i. a source of nickel ions;
   ii. a source of hypophosphite ions;
   iii. at least one complexing agent;
   iv. a flex additive, wherein the flex additive comprises a guanidine derivative;
   v. optionally, a pH adjuster; and
   vi. optionally, a bath stabilizer; and
   vii. optionally, a source of lead ions;

wherein the nickel phosphorus plating layer deposited on the substrate exhibits a columnar grain structure.

DETAILED DESCRIPTION OF THE PREFERRED EMBODIMENTS

As described herein, the present invention is directed to a method of plating a bendable nickel alloy that exhibits a columnar grain structure, which may be an nickel phosphorus alloy or a ternary or quaternary alloy on a flexible substrate and compositions for use therein.

As used herein, "a," "an," and "the" refer to both singular and plural referents unless the context clearly dictates otherwise.

As used herein, the term "about" refers to a measurable value such as a parameter, an amount, a temporal duration, and the like and is meant to include variations of +/−15% or less, preferably variations of +/−10% or less, more preferably variations of +/−5% or less, even more preferably variations of +/−1% or less, and still more preferably variations of +/−0.1% or less of and from the particularly recited value, in so far as such variations are appropriate to perform in the invention described herein. Furthermore, it is also to be understood that the value to which the modifier "about" refers is itself specifically disclosed herein.

As used herein, spatially relative terms, such as "beneath," "below," "lower," "above," "upper" and the like, are used for ease of description to describe one element or feature's relationship to another element(s) or feature(s) as illustrated in the figures. Spatially relative terms may be intended to encompass different orientations of the device in use or operation in addition to the orientation depicted in the figures.

It is further understood that the terms "front" and "back" are not intended to be limiting and are intended to be interchangeable where appropriate.

As used herein, the terms "comprises" and/or "comprising," specify the presence of stated features, integers, steps, operations, elements, and/or components, but do not preclude the presence or addition of one or more other features, integers, steps, operations, elements, components, and/or groups thereof.

As used herein, the term "lamellar structure" refers to a structure or microstructure that is composed of fine, alternating layers of different materials in the form of lamella that are formed on a surface of a substrate.

As used herein, the term "columnar structure" refers to a structure or microstructure that is composed of nearly parallel vertical columns that form perpendicular to a surface of the substrate.

Figure 1:
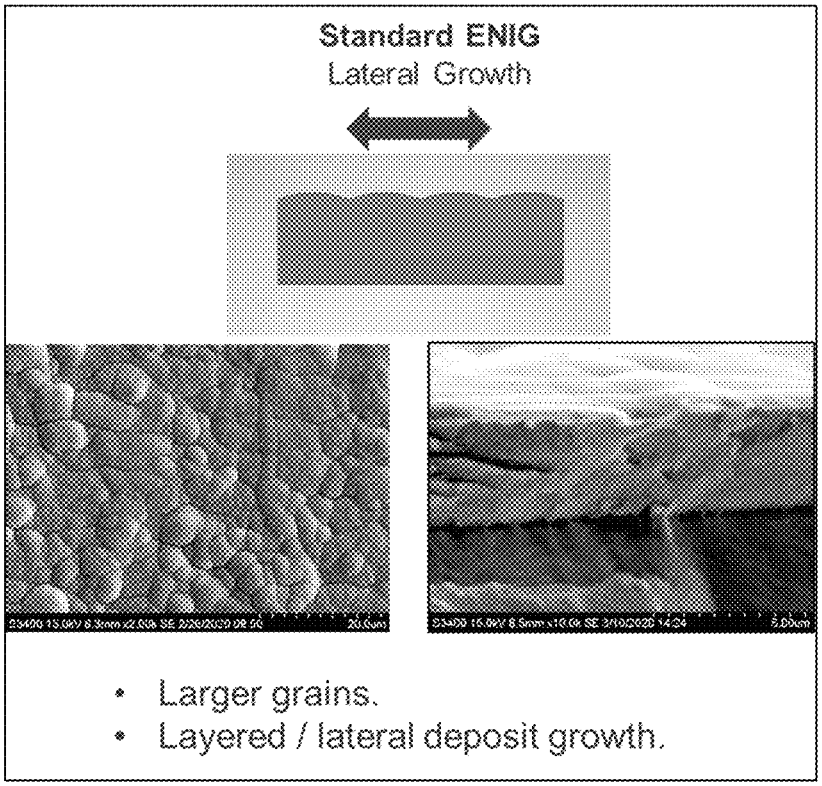
FIG. 1 is an image of a standard electroless nickel immersion gold (ENIG) configuration on a substrate and in which the electroless nickel phosphorus deposit exhibits lamellar growth.
Figure 2:
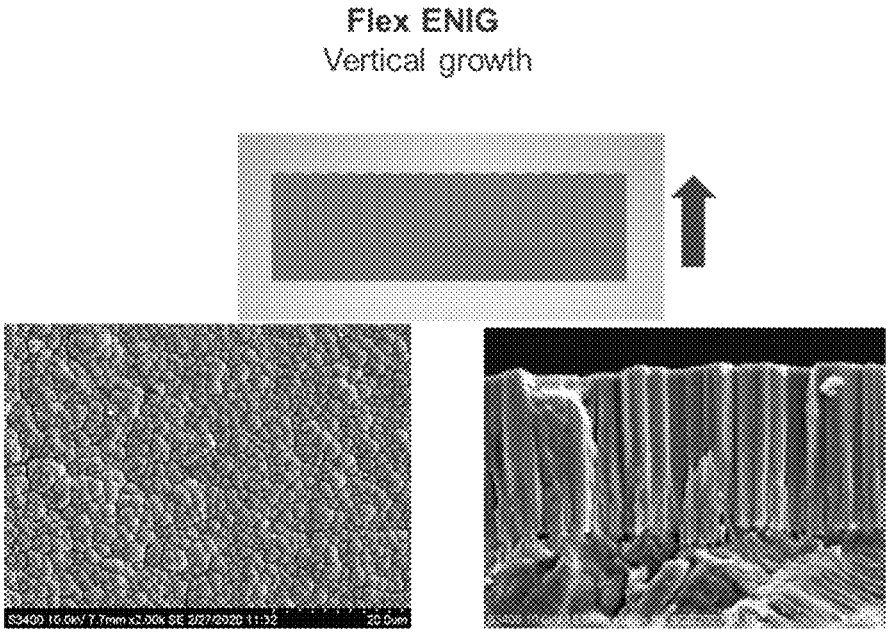
FIG. 2 is an image of a flexible electroless nickel immersion gold (ENIG) configuration on a substrate in accordance with the invention described herein and in which the electroless nickel phosphorus deposit exhibits vertical columnar growth.
Figure 3:
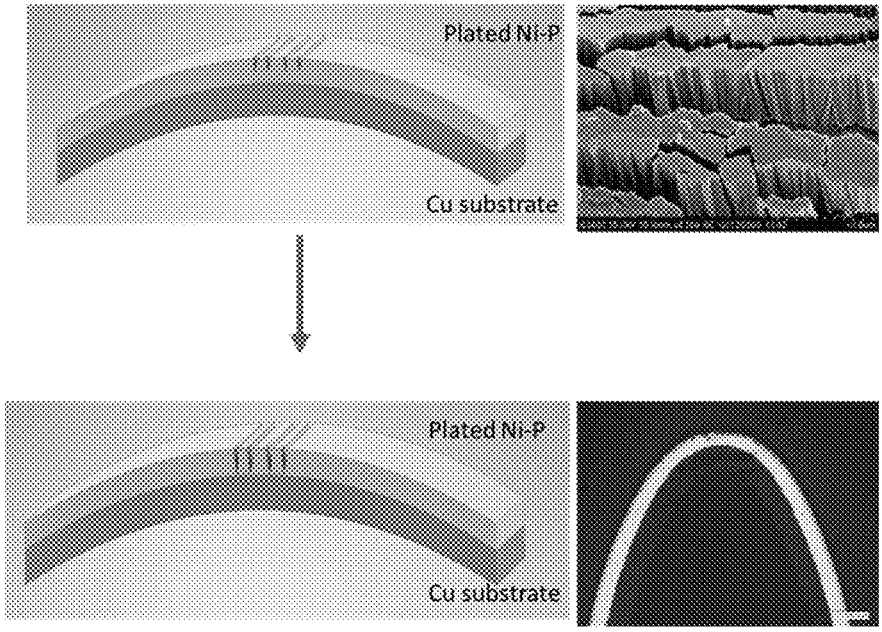
FIG. 3 depicts the crack propagation and stress relief of standard ENIG deposit as compared with flexible ENIG deposit.

FIG. 1 depicts an image of a standard electroless nickel immersion gold (ENIG) configuration on a substrate and in which the electroless nickel phosphorus deposit exhibits lamellar growth. It can be seen that a nickel phosphorus layer deposited using a conventional electroless nickel plating solution does not produce a layer that is bendable. FIG. 1 shows that upon bending, stress is relieved via a large crack and crack propagation proceeds into the underlying copper layer. In contrast, FIG. 2 depicts an image of a flexible electroless nickel immersion gold (ENIG) configuration on a substrate in which the electroless nickel phosphorus deposit exhibits vertical columnar growth. As shown in FIG. 3, upon bending, stress is relieved through multiple small cracks that prevent propagation through to the underlying copper.

In one embodiment, the present invention relates generally to an electroless nickel-phosphorus bath composition comprising:

a) a source of nickel ions;
b) a source of hypophosphite ions;
c) at least one complexing agent;
d) a flex additive, wherein the flex additive comprises a guanidine derivative;
e) optionally, a pH adjuster;
f) optionally, a bath stabilizer; and
g) optionally, a source of lead ions.

The electroless nickel-phosphorus plating solution is used in an electroless nickel plating process to deposit a bendable electroless nickel alloy layer on a flexible substrate, such as a flexible printed circuit board having copper circuitry thereon.

As discussed above, previous attempts to produce an electroless nickel-phosphorus plating bath that is capable of printing a bendable columnar nickel deposit on a substrate have focused on the use of additives such as amines, diamines, cyans, formaldehyde, and bismuth as flex additives in order to modify the structure of the nickel from lamellar to columnar.

The inventors of the present invention have discovered other flex additives that can transform the grain structure of the nickel-phosphorus alloy from lamellar to columnar that are inexpensive, non-volatile, do not require any special working conditions with respect to the health and safety of the operator and can be incorporated into standard electroless nickel plating baths to produce a bendable nickel phosphorus layer on the substrate. Thereafter, additional layers such as an immersion gold (IG) layer or electroless palladium (EP) can be deposited on the bendable nickel phosphorus layer to produce an electroless nickel immersion gold (ENIG) or electroless nickel, electroless palladium, immersion gold (ENEPIG) configuration that is bendable.

The aqueous plating bath composition used in the method according to the present invention comprises nickel ions added in the form of a water soluble nickel salt such as nickel chloride, nickel sulfate, nickel acetate and/or nickel nitrate. In one embodiment, the water soluble nickel salt is nickel sulfate.

In one embodiment, the concentration of nickel ions in the bath is in the range of about 1 to about 20 g/L, more preferably about 2 to about 15 g/L, more preferably about 3 to about 10 g/L.

The aqueous plating bath also comprises a source of hypophosphite ions as the reducing agent. In one embodiment, the source of hypophosphite ions is selected from the group consisting of hypophosphorous acid or a bath soluble salt thereof such as sodium hypophosphite, potassium hypophosphite and ammonium hypophosphite. In embodiment, the source of hypophosphite ions comprises sodium hypophosphite. The concentration of the hypophosphite ions is preferably in the range of about 1 to about 60 g/l, more preferably about 10 to about 50 g/l and most preferably from about 20 to about 45 g/l. In addition, the reducing agent can be replenished in the bath as needed during the reaction.

The aqueous plating bath also comprises one or more complexing agents and the one or more complexing agents are used in the bath at a concentration within the range of about 5 to about 90 g/L, more preferably about 20 to about 50 g/L. The one or more complexing agents may be selected from the group consisting of carboxylic acids, substituted carboxylic acids, unsaturated carboxylic acids, and mixtures thereof. In one embodiment, the carboxylic acid, substituted carboxylic acid or unsaturated carboxylic acid comprise at least one of a monocarboxylic acid, a dicarboxylic acid, a tricarboxylic acid, an aminocarboxylic acid, a hydroxycarboxylic acid, or combinations thereof. Examples of suitable carboxylic acids include, but are not limited to, acetic acid, propionic acid, glycolic acid, lactic acid, pyruvic acid, succinic acid, glutaric acid, itaconic acid, adipic acid, maleic acid, fumaric acid, malic acid, citric acid, aminoacetic acid, 2-aminopropanoic acid, aspartic acid combinations thereof. In one embodiment, at least one of the at least one complexing agent is selected from the group consisting of acetic acid, propionic acid, glycolic acid, lactic acid, pyruvic acid, succinic acid, glutaric acid, itaconic acid, adipic acid, maleic acid, fumaric acid, malic acid, citric acid, aminoacetic acid, 2-aminopropanoic acid, aspartic acid combinations thereof. The complexing agents may be introduced into the aqueous plating bath as their sodium, potassium or ammonium salts. Complexing agents such as acetic acid may also act as a buffering agent, and the appropriate concentration of such additive components can be optimized for any plating bath in consideration of their dual functionality.

In addition, when certain organic flex additives are used in the electroless nickel phosphorus bath, the inventors of the present invention have surprisingly discovered that it is important that the electroless nickel baths contain at least one dicarboxylic acid or a substituted dicarboxylic acid such as succinic acid, adipic acid, glutaric acid, itaconic acid, fumaric acid and in certain concentrations in order to produce a nickel phosphorus deposit that exhibits sufficient bendability.

In addition, it has also surprisingly been discovered that in order to produce the desired columnar grain structure, carboxylic acids containing hydroxy groups, such as malic acid, tartaric acid, or malonic acid, are generally not preferred, especially in combination with certain flex additives. However, depending on the particular selection and concentration of the guanidine derivative flex additive and the particular hydroxy carboxylic acid and its concentration, in combination with certain other bath additives, it is certainly possible that the desired columnar grain structure may be achievable.

In one embodiment, the electroless nickel phosphorus bath composition comprises about 10 g/L to about 70 g/L, more preferably about 15 g/L to about 60 g/L, more preferably about 20 g/L to about 50 g/L lactic acid as the complexing agent.

In one embodiment, the electroless nickel phosphorus bath composition comprises about 1 g/L to about 70 g/L, more preferably about 5 g/L to about 60 g/L, more preferably about 8 g/L to about 50 g/L succinic acid as the complexing agent.

In one embodiment, where multiple complexing agents are used the bath composition includes one or more of a monocarboxylic acid and a dicarboxylic acid. In one embodiment, the electroless nickel phosphorus bath composition comprises about 1 g/L to about 60 g/L, more preferably about 5 to about 40 g/L, more preferably about 8 to about 25 g/L monocarboxylic acid as the complexing agent and about 5 g/L to about 60 g/L, more preferably about 10 g/L to about 50 g/L, more preferably about 25 g/L to about 45 g/L of dicarboxylic acid as the complexing agent.

In one embodiment the monocarboxylic acid comprises lactic acid. In one embodiment, the dicarboxylic or substituted dicarboxylic acid may comprise succinic acid, adipic acid, glutaric acid, fumaric acid, or itaconic acid. In one embodiment, a combination of lactic acid and succinic acid is used in the electroless nickel composition. In one embodiment, lactic acid is used in combination with one or more of one or more of succinic acid, adipic acid, glutaric acid, fumaric acid, itaconic acid, and combinations thereof.

In one embodiment, the electroless nickel plating bath also includes a flex additive. Examples of suitable flex additives that have been found to produce a good result are represented by the following general structure:

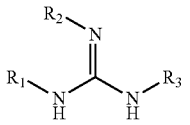

wherein $R_2$=H and $R_3$=H, methyl, ethyl, propyl, isopropyl $R_1$=$NH_2$, COOH, CN, OH,

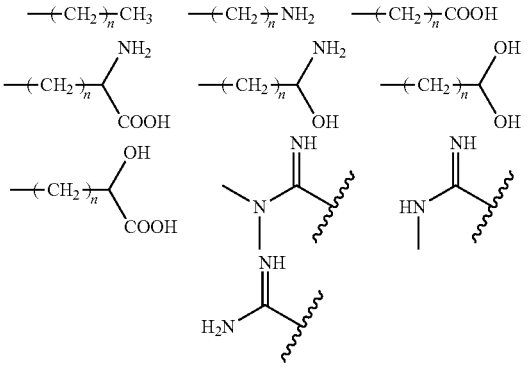

where n=1-7

Examples of suitable flex additives, include, for example, guanidine derivatives including, but not limited to aminoguanidine, agmatine (1-amino-4-guanidinobutane sulfate salt), 3-guanidinopropionic acid, 1-cyanoguanidine, arginine (2-amino-5-guanidinopentanoic acid), metformin (1,1-dimethylbiguanide hydrochloride), other similar compounds, and combinations of one or more of the foregoing.

In one embodiment, it is preferred that the flex additive is stable up to at least 4 MTO, preferably at least 5 MTO, and even more preferably at least 6 MTO. In addition, depending on the particular flex additive in the electroless nickel bath along with the concentration of the flex additive, it may not be necessary to add an additional metal stabilizer. The concentration of the flex additive in the electroless nickel phosphorus plating bath is preferably within the range of about 0.01 g/L to about 100 g/L, more preferably about 0.05 g/L to about 50 g/L, more preferably about 0.1 to about 30 g/L. However, the concentration of the flex additive will also depend in part on the particular flex additive(s) being used and the other bath constituents and their concentrations.

The aqueous electroless nickel plating baths described herein can be operated over a broad pH range such as from about 3 to about 6. For an acidic bath, the pH can generally range from about 4 to about 5.5, more preferably from about 4.7 to about 5.4. For an alkaline bath, the pH can range from about 7 to about 10, more preferably from about 8 to about 9. Since the plating solution has a tendency to become more acidic during its operation due to the formation of hydrogen ions, the pH may be periodically or continuously adjusted by adding bath-soluble and bath-compatible alkaline substances such as sodium, potassium or ammonium hydroxides, carbonates and bicarbonates.

In one embodiment, one or more bath stabilizers are added to provide a sufficient bath lifetime and reasonable deposition rate and to control the content of any alloying materials. For example, the stabilizing agent may be used to control the phosphorus content in the as deposited nickel phosphorus alloy. Stabilizing agents include organic and/or inorganic stabilizing agents such as lead ions, cadmium ions, tin ions, bismuth ions, antimony ions and zinc ions, which can be introduced in the form of bath soluble and compatible salts such as the acetates. Suitable bismuth compounds include, for example, bismuth oxide, bismuth sulfate, bismuth sulfite, bismuth nitrate, bismuth chloride, bismuth acetate and the like. Organic stabilizers include sulfur containing compounds such as, for example, thioglycolic acid, thiodiglycolic acid, thiourea, mercaptans, sulfonates, thiocyanates, and combinations of one or more of the foregoing. The stabilizers are typically used in small amounts such as from 0.01 to 5 mg/L of solution, and more often in amounts of about 0.05 to 2.5 mg/L of solution. The upper limit of the concentration of the metal stabilizers is such that the deposition velocity is not reduced. In one embodiment, the organic flex additive also acts as a stabilizer and an additional stabilizer is not required. Thus, in one embodiment, the electroless nickel phosphorus plating bath is at least substantially free of any additional stabilizer absent the stabilizing effect provided by the organic flex additive.

In one embodiment, the electroless nickel-phosphorus plating bath is also preferably at least substantially free of formaldehyde and formaldehyde precursors. By "substantially free" what is meant is that no formaldehyde or formaldehyde precursors are intentionally added to the plating bath solution and the only formaldehyde or formaldehyde precursor that may be present in the electroless nickel phosphorus plating bath is trace amounts that may occur as a result of breakdown of various elements in the plating bath.

Other materials may be included in the nickel plating solutions such as buffers, wetting agents, and thermal stabilizers. These materials are known in the art.

The nickel plating bath optionally contains one or more wetting agents of any of the various types heretofore known which are soluble and compatible with the other bath constituents. In one embodiment, the use of such wetting agents prevents or hinders pitting of the nickel-phosphorous alloy deposit, and the wetting agents can be employed in amounts up to about 1 g/l.

In one embodiment, the nickel phosphorus alloy is a nickel phosphorus ternary or quaternary nickel alloy, and one or more additional alloying elements such as tungsten, tin, iron, cobalt, chromium, cobalt, manganese, etc. may be added to the electroless nickel phosphorus plating solution in the form of a suitable salt of the alloying metal.

In one embodiment, the aqueous plating bath described herein is used in a method for electroless deposition of a bendable nickel-phosphorus alloy layer onto a flexible substrate, the method comprising the steps of:

a. providing a flexible substrate, wherein the flexible substrate preferably comprises copper circuitry attached to at least one side of the flexible substrate;
b. contacting the flexible substrate with an aqueous electroless nickel-phosphorus bath composition comprising:
   a) a source of nickel ions;
   b) a source of hypophosphite ions;
   c) at least one complexing agent;
   d) a flex additive, wherein the flex additive comprises a compound represented by the following general structure:

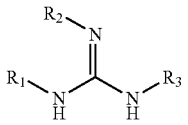

wherein $R_2$=H and $R_3$=H, methyl, ethyl, propyl, isopropyl
$R_1$=$NH_2$, COOH, CN, OH,

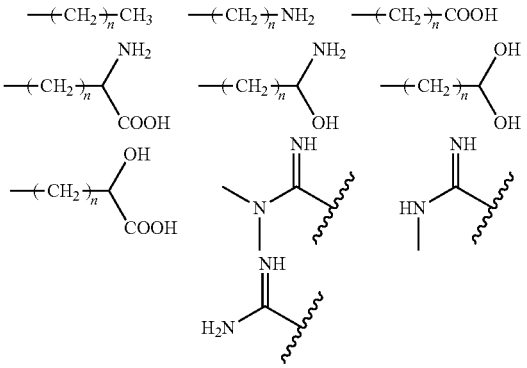

where n=1-7.

e) optionally, a pH adjuster;
   f) optionally, a bath stabilizer, and
   g) optionally, a source of lead ions.

wherein a bendable nickel-phosphorus alloy is deposited onto the copper circuitry attached to the at least one side of the flexible substrate.

As described herein, in one embodiment, the flexible substrate is a flexible printed circuit board or flexible printed wiring board that comprises copper circuitry on at least one side thereof.

The flexible substrate with the copper circuitry printed or otherwise disposed thereon is first cleaned, preferably with an aqueous acidic cleaner.

Next, the copper surface (i.e., copper circuitry) is microetched by contacting the substrate with a microetching composition. In one embodiment, the substrate is contacted with the microetching composition by immersing the substrate in an aqueous solution comprising sulfuric acid and an oxidizing agent such as hydrogen peroxide.

Thereafter, the cleaned and microetched substrate is activated by contacting at least the copper surface or copper circuitry of the substrate with a suitable palladium activation solution, such as by immersion, in order to deposit a palladium seed layer onto the copper surface. The palladium ions are deposited onto the copper surface, reduced by copper to metallic state palladium and copper ions are released into the immersion plating bath. The resulting activated copper surface is then composed of metallic palladium which serves as a seed layer for a subsequent electroless nickel-phosphorous alloy plating step.

The palladium activator is contacted with the substrate by immersion plating, spray coating etc. for a period of about 30 seconds to about 5 minutes, more preferably about 1 minute to about 2 minutes and at a temperature of about 0 to about 70° C., more preferably about 15 to about 50° C. to catalyze the surface of the substrate.

Thereafter, the catalyzed substrate is contacted with the aqueous electroless nickel phosphorus plating solution described herein to deposit a layer of layer of nickel phosphate having a columnar structure thereon.

As described herein, the electroless nickel-phosphorus bath composition is an aqueous solution that generally comprises:

a. a source of nickel ions;
b. a source of hypophosphite ions;
c. at least one complexing agent;
d. a flex additive, wherein the flex additive comprises a compound represented by the following general structure:

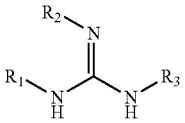

wherein $R_2$=H and $R_3$=H, methyl, ethyl, propyl, isopropyl
$R_1$=$NH_2$, COOH, CN, OH,

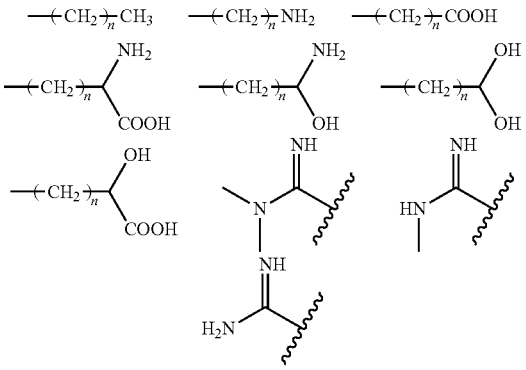

where n=1-7.

e. optionally, a pH adjuster;

f. optionally, a stabilizer, and g. optionally, a source of lead ions.

In one embodiment, the electroless nickel-phosphorus bath is an aqueous solution comprising:

a. a source of nickel ions;

b. a source of hypophosphite ions;

c. at least one complexing agent, wherein the at least one complexing agent comprises a carboxylic acid, a substituted carboxylic acid, an unsaturated carboxylic acid, or combinations thereof, optionally wherein the carboxylic acid comprises at least one of a monocarboxylic acid and a dicarboxylic acid;

d. a flex additive, wherein the flex additive comprises a compound represented by the following general structure:

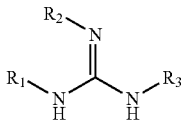

wherein $R_2$=H and $R_3$=H, methyl, ethyl, propyl, isopropyl $R_1$=$NH_2$, COOH, CN, OH,

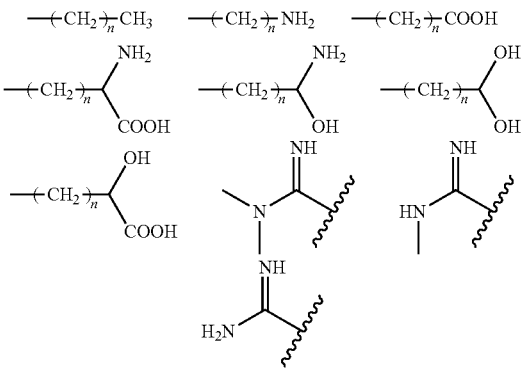

where n=1-7.

e. optionally, a pH adjuster;

f. optionally, a bath stabilizer; and g. optionally, a source of lead ions;

wherein the electroless nickel phosphorus plating bath is configured to deposit a bendable nickel-phosphorus plating layer on a substrate having a columnar grain structure;

wherein the electroless nickel phosphorus plating bath is at least substantially free of any ingredient that would prevent the electroless nickel phosphorus plating bath from producing the nickel phosphorus plating having the columnar grain structure.

As described herein, any ingredients that would prevent the electroless nickel-phosphorus plating bath from producing the desired columnar structure required to pass a Bend Test as further described herein are specifically excluded from the composition. That is, it is desired that the microstructure contains only vertical columnar grains and is at least substantially free of any lamellar grains that would detract from the bendability of the resulting nickel-phosphorus deposit and prevent the deposit from passing the Bend Test.

In one embodiment, the electroless nickel plating bath composition is maintained at a pH within the range of about 3 to about 6, more preferably from about 4.5 to about 5.5. The bath can be maintained within the desired pH range by adding a pH adjuster such as 30% ammonia solution or dilute sulfuric acid solution.

The flexible substrate to be plated is contacted with the aqueous plating bath while the bath is maintained at a temperature within the range of about 40° C. up to about 95° C., more preferably at a temperature of about 60° C. to about 95° C., and more preferably, at a temperature of from about 70° C. to about 90° C.

In one embodiment the based substrate comprises a polyimide polymer sheet onto which copper circuitry is printed. The copper circuitry is typically about 10 to about 30 μm in thickness, more preferably 12 to about 25 μm in thickness and the thickness of the nickel phosphorus alloy printed on the copper circuitry is generally in the range of about 0.5 to about 10 μm, more preferably about 3 to about 5 μm. The nickel-phosphorous alloy layer has a thickness in the range of 0.5 to 5 μm and a phosphorous content of 4 to 12 wt. %.

The nickel alloy deposit also has a phosphorus content in the range of about 2 to about 13 wt. %, more preferably about 5 to about 12 wt. %. In addition, if the alloy is a ternary or quaternary alloy, the additional alloying metal may be present at about 0.1% to about 50 wt. %, more preferably about 1 to about 40 wt. %. Various alloying metals can be used including, for example one or more of tungsten, tin, iron, cobalt, chromium, manganese, and molybdenum.

Thereafter, one or more of an electroless palladium and an immersion gold layer may be deposited on top of the electroless nickel phosphorus layer. Suitable electroless palladium and immersion gold compositions would be known to those skilled in the art.

The duration of contact of the electroless nickel plating bath with the flexible substrate being plated is a function which is dependent on the desired thickness of the nickel phosphorus alloy. Typically, the contact time can range from 1 to 60 minutes, more preferably from 5 to 45 minutes.

The flexible substrate to be coated with a nickel-phosphorous alloy can be contacted with the plating bath according to the method of the present invention by dipping the flexible substrate into the plating bath or by spraying the plating bath onto the flexible substrate.

During deposition of the nickel phosphorous alloy, mild agitation may be employed. Agitation may be a mild air agitation, mechanical agitation, bath circulation by pumping, movement of the flexible substrate, etc. The plating bath may also be subjected to a periodic or continuous filtration treatment to reduce the level of contaminants therein. Replenishment of the constituents of the plating bath may also be performed, in some embodiments, on a periodic or continuous basis to maintain the concentration of constituents, and in particular, the concentration of nickel ions and hypophosphite ions, as well as the pH level within the desired limits.

The invention will now be illustrated by reference to the following non-limiting examples.

As described in the examples below, once the nickel phosphorus layer is deposited onto the substrate, it is subjected to a bend test to evaluate its suitability. The bend test is performed by depositing a 3 to 5 μm nickel layer on a copper substrate and using a Folding Endurance Tester, such as an MIT Folding Endurance Tester to evaluate the flexibility of the nickel phosphorus layer. The conditions for evaluating the flexibility using the MIT Bend Tester are as follows:

| Property | Value |
|---|---|
| Bending angle | 135° |
| Bending rate | 175 rpm |
| Load | 500 g |
| Curvature | 0.38 mm |
| Polyimide foil | 12 μm Cu/60 μm polyimide |
| Spacing | 100 μm |

Alternatively, bend testing can be performed according to ASTM D2176-16(2021), which is a standard test method for folding endurance of paper and plastics film using an MIT Folding Endurance Tester.

The nickel phosphorus alloy layer is evaluated to determine the number of bends that the plated copper can achieve prior to snapping. The criteria for acceptable bendability is determined by subjecting a specific number of plated specimens to the bend test, calculating an average number from the bends that were obtained from multiple specimens. Similarly, a specific number of base copper specimens (that are without any nickel-phosphorus deposits plated on it) are also subjected to the bend test. The average number of bends that the plated specimens can undergo before break is compared to the average of bends from the original copper substrate. The nickel phosphorus layer is determined to have excellent bendability (and thus pass a Bend Test) when it can meet an average target of at least 25% of bends compared to copper prior to breaking or snapping. In contrast, a standard nickel phosphorus deposit typically snaps immediately (i.e., 0 bends prior to breakage), which would fail the Bend Test. In addition, the deposition of a nickel phosphorus layer that contains both columnar structure and lamellar structure would also likely fail the Bend Test.

Examples

Experimental Conditions for the Examples are Outlined Below:

Dielectric substrates with a layer or circuitry of copper thereon were brought into contact with a palladium activator solution for a period of 10 seconds to 5 minutes at a temperature of 25° C. to 50° C. to catalyze the surface of the substrate. Thereafter, the palladium catalyzed copper layers or circuitry were contacted with the aqueous electroless nickel phosphorus plating solutions described below in Tables 1 and 2. The agitation was maintained at 240 rpm during the electroless nickel plating process in beaker scale baths. Specimens were affixed on plastic frames and suspended in the plating baths.

Electroless nickel bath plating times were controlled between 15 minutes to 45 minutes depending on the desired thickness and bath temperatures ranged from 78° C. to 90° C. depending upon bath composition as per the examples listed below. The pH was maintained at about 5.

The resulting nickel phosphorus deposits were examined by SEM and determined to be columnar in nature in the examples versus the comparative examples. The deposit was subjected to a Bend Test as described above and the results are presented in Tables 1 and 2 below.

Figure 4:
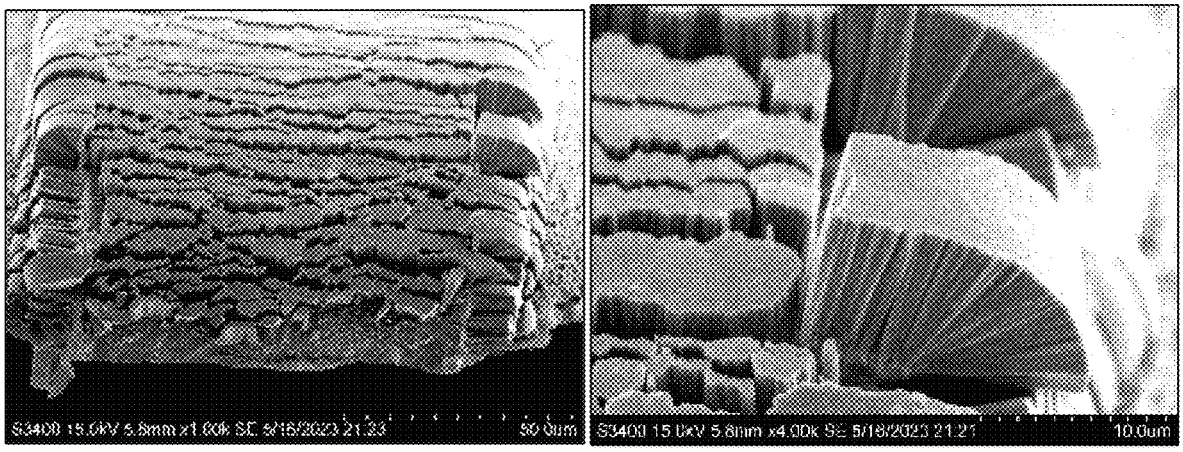
FIG. 4 depicts an SEM showing the crack pattern and columnar formation of Ni—P due to the presence of the flex additive in the electroless nickel bath in accordance with Example 2.

As set forth in Table 1, in Examples 1 to 4, and Comparative Examples 1 to 3, the complexing agent comprises a combination of succinic and lactic acid. In Example 5, the complexing agent is succinic acid. Different flex additives were used in each of the Examples. These Examples demonstrate that various guanidine derivatives can be used to provide the desired columnar structure that is capable of passing the Bend Test, while guanidine and shorter chain guanidine derivatives produced a lamellar structure that failed the Bend Test. FIG. 4 depicts an SEM of the cracking pattern and columnar microstructure of Ni—P due to aminoguanidine sulfate as demonstrated by Example 2.

Figure 5:
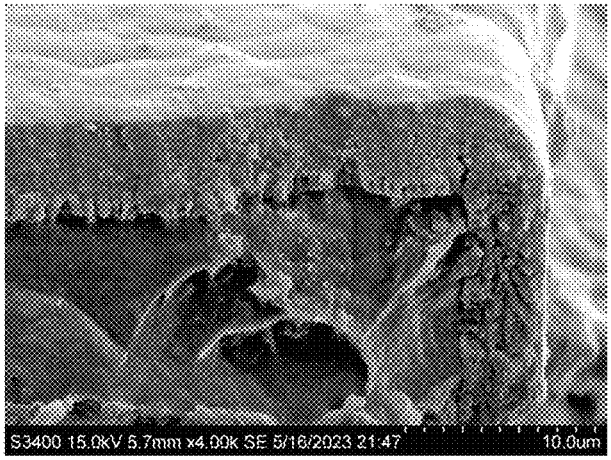
FIG. 5 depicts an SEM showing the lamellar structure formation of Ni—P in the presence of a non-flex promoting additive in accordance with Comparative Example 3.

The nickel phosphorus layers of Comparative Examples 1 to 3 were also evaluated to determine the number of bends that the plated copper can achieve prior to snapping. The nickel phosphorus layers of Comparative Examples 1 to 3 were plated using compositions that included additives that were not able to achieve columnar structure and instead exhibited lamellar structure. Therefore the plated layers of Comparative Examples 1 to 3 were not able to pass a bendability test and snapped immediately (i.e., 0 bends prior to breakage). FIG. 5 depicts an SEM that shows the lamellar structure formation of NI—P due to the presence of an non-flex promoting additive as demonstrated by Comparative Example 3.

As set forth in Table 2, metformin was used as the flex additive and various carboxylic acids and combinations of carboxylic acids were evaluated. Examples 3 and 6-9 demonstrate that a combination of a monocarboxylic acid (i.e., lactic acid) and dicarboxylic acids with metformin as the flex additive were able to achieve a columnar grain structure and pass the Bend Test. Comparative Example 4 used only lactic acid as the complexing agent and the resulting deposit was lamellar and failed the Bend Test. Comparative Example 5 used as combination of lactic acid and malonic acid and resulted in mixed columnar and lamellar grain structure that was not able to pass the Bend Test. Comparative Examples 6 and 7 used a combination of lactic acid and either malic acid or tartaric acid and resulted in the Ni—P exhibiting a lamellar structure that was not able to pass the Bend Test.

Thus, it can be seen that certain combinations and types of complexing agents and flex additives in an electroless nickel-phosphorus bath are capable of achieving a columnar grain structure when deposited on substrate containing copper circuitry. These bendable electroless nickel phosphorus layers exhibit a columnar structure and are able to pass a Bend Test as described herein.

TABLE 1

| | Ex. 1 | Ex. 2 | Ex. 3 | Ex. 4 | Ex. 5 | Comp. Ex. 1 | Comp. Ex. 2 | Comp. Ex. 3 |
|---|---|---|---|---|---|---|---|---|
| Nickel Sulfate Hexahydrate | 25 g/L | 25 g/L | 25 g/L | 25 g/L | 25 g/L | 25 g/L | 25 g/L | 25 |
| Sodium hypophosphite | 30 g/L | 30 g/L | 30 g/L | 30 g/L | 30 g/L | 30 g/L | 30 g/L | 30 |
| Lactic acid | 30 g/L | 30 g/L | 30 g/L | 30 g/L | | 30 g/L | 30 g/L | 30 |
| Succinic acid | 30 g/L | 30 g/L | 30 g/L | 30 g/L | 30 g/L | 30 g/L | 30 g/L | 30 |
| 3-guanidinopropionic acid | 15 g/L | | | | | | | |
| Aminoguanidine sulfate | | 8 g/L | | | | | | |

TABLE 1-continued

| | Ex. 1 | Ex. 2 | Ex. 3 | Ex. 4 | Ex. 5 | Comp. Ex. 1 | Comp. Ex. 2 | Comp. Ex. 3 |
|---|---|---|---|---|---|---|---|---|
| Metformin | | | 10 g/L | | | | | |
| Arginine | | | | 15 g/L | | | | |
| 1-cyanoguanidine | | | | | 1 g/L | | | |
| Guanidine hydrochloride | | | | | | 26 g/L | | |
| Dimethyl guanidine sulfate | | | | | | | 15 g/L | |
| Methyl guanidine hydrochloride | | | | | | | | 6 g/L |
| Lead (ppm) | 0.5 | 0.5 | 0.5 | 0.5 | | 0.5 | 0.5 | 0.5 |
| Thiodiglycolic acid (ppm) | 0.3 | 0.3 | 0.3 | 0.3 | 0.3 | 0.3 | 0.3 | 0.3 |
| EN bath temperature (° C.) | 80 | 82 | 83 | 85 | 90 | 83 | 83 | 83 |
| Plating time (minutes) | 30 | 30 | 30 | 30 | 45 | 30 | 30 | 30 |
| Ni—P thickness (μm) | 3-5 | 3-5 | 3-5 | 3-5 | 3-5 | 3-5 | 3-5 | 3-5 |
| Structure by SEM | Columnar | Columnar | Columnar | Columnar | Columnar | Lamellar | Lamellar | Lamellar |
| Bend test | Pass | Pass | Pass | Pass | Pass | Fail | Fail | Fail |

TABLE 2

| | Ex. 3 | Ex. 6 | Ex. 7 | Ex. 8 | Ex. 9 | Comp. Ex. 4 | Comp. Ex. 5 | Comp. Ex. 6 | Comp. Ex. 7 |
|---|---|---|---|---|---|---|---|---|---|
| Nickel Sulfate | 25 g/L | 25 g/L | 25 g/L | 25 g/L | 25 g/L | 25 g/L | 25 g/L | 25 g/L | 25 g/L |
| Sodium hypophosphite | 30 g/L | 30 g/L | 30 g/L | 30 g/L | 30 g/L | 30 g/L | 30 g/L | 30 g/L | 30 g/L |
| Metformin | 10 | 15 | 15 | 10 | 10 | 10 | 10 | 10 | 10 |
| Lactic acid | 25 | 25 | 25 | 25 | 25 | 25 | 25 | 25 | 25 |
| Malonic acid | | | | | | | 30 | | |
| Succinic acid | 30 | | | | | | | | |
| Adipic acid | | 30 | | | | | | | |
| Glutaric acid | | | 30 | | | | | | |
| Fumaric acid | | | | 30 | | | | | |
| Itaconic acid | | | | | 30 | | | | |
| Malic acid | | | | | | | | 30 | |
| Tartaric acid | | | | | | | | | 30 |
| Lead (ppm) | 0.5 | 0.5 | 0.5 | 0.5 | 0.5 | 0.5 | 0.5 | 0.5 | 0.5 |
| Thiodiglycolic acid (ppm) | 0.3 | 0.3 | 0.3 | 0.3 | 0.3 | 0.3 | 0.3 | 0.3 | 0.3 |
| EN bath temp. (° C.) | 83 | 83 | 83 | 83 | 83 | 83 | 83 | 83 | 83 |
| Plating time (minutes) | 30 | 30 | 30 | 30 | 30 | 30 | 30 | 30 | 30 |
| Ni—P thickness (μm) | 3-5 | 3-5 | 3-5 | 3-5 | 3-5 | 3-5 | 3-5 | 3-5 | 3-5 |
| Structure by SEM | Columnar | Columnar | Columnar | Columnar | Columnar | Lamellar | Mixed Columnar and Lamellar | Lamellar | Lamellar |
| Bend test | Pass | Pass | Pass | Pass | Pass | Fail | Fail | Fail | Fail |

Finally, it should be understood that the following clauses and claims are intended to cover all of the generic and specific features of the invention described herein and all statements of the scope of the invention that as a matter of language might fall therebetween.

Clause 1: An electroless nickel phosphorus plating bath comprising:

a. a source of nickel ions;

b. a source of hypophosphite ions;

c. at least one complexing agent;

d. a flex additive, wherein the flex additive comprises a compound represented by the following general structure:

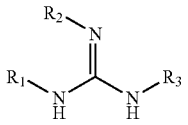

wherein $R_2$=H and $R_3$=H, methyl, ethyl, propyl, isopropyl $R_1$=$NH_2$, COOH, CN, OH,

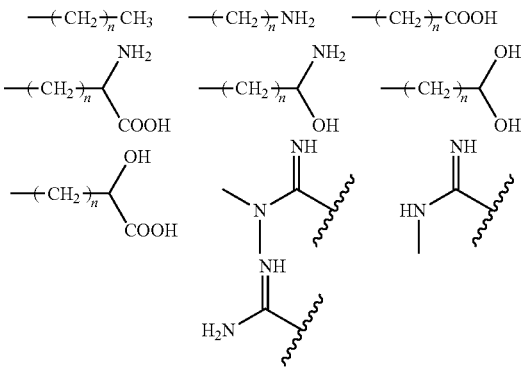

where n=1-7.

e. optionally, a pH adjuster;

f. optionally, a bath stabilizer; and g. optionally, a source of lead ions;

wherein the electroless nickel phosphorus plating bath is configured to deposit a nickel-phosphorus plating layer on a substrate having a columnar grain structure;

wherein the electroless nickel phosphorus plating bath is at least substantially free of any ingredient that would prevent the electroless nickel phosphorus plating bath from producing the nickel phosphorus plating having the columnar grain structure.

Clause 2: The electroless nickel phosphorus plating bath according to clause 1, wherein the organic flex additive comprises a guanidine derivative.

Clause 3: The electroless nickel phosphorus plating bath according to clause 1 or 2, wherein the electroless nickel phosphorus plating bath is at least substantially free of formaldehyde and formaldehyde precursors.

Clause 4: The electroless nickel phosphorus plating bath according to any of the preceding clauses, wherein the electroless nickel phosphorus plating bath includes at least one of a buffer and a wetting agent.

Clause 5: The electroless nickel phosphorus plating bath according to any of the preceding clauses, wherein the electroless nickel phosphorus plating bath includes one more additional alloying metals, wherein the one or more additional alloying metals are selected from the group consisting of tungsten, tin, iron, cobalt, chromium, cobalt, manganese, and combinations of the foregoing.

Clause 6: The electroless nickel phosphorus plating bath according to any of the preceding clauses, wherein the electroless nickel phosphorus plating bath composition is maintained at a pH within the range of about 3 to about 6.

Clause 7: The electroless nickel phosphorus plating bath according to any of the preceding clauses, wherein the at least one complexing agent comprises a carboxylic acid, a substituted carboxylic acid, an unsaturated carboxylic acid or a combination of the foregoing.

Clause 8: The electroless nickel phosphorus plating bath according to clause 7, wherein the carboxylic acid, substituted carboxylic acid or unsaturated carboxylic acid comprise at least one of a monocarboxylic acid, a dicarboxylic acid, a tricarboxylic acid, an aminocarboxylic acid, a hydroxycarboxylic acid, or combinations thereof.

Clause 9: The electroless nickel phosphorus plating bath according to clause 7 or clause 8, wherein at least one of the at least one complexing agent is selected from the group consisting of acetic acid, propionic acid, glycolic acid, lactic acid, pyruvic acid, succinic acid, glutaric acid, itaconic acid, adipic acid, maleic acid, fumaric acid, malic acid, citric acid, aminoacetic acid, 2-aminopropanoic acid, aspartic acid combinations thereof.

Clause 10: The electroless nickel phosphorus plating bath according to any of clauses 7 to 9, wherein the at least one complexing agent comprises lactic acid and one or more of succinic acid, adipic acid, glutaric acid, fumaric acid, itaconic acid, and combinations thereof.

Clause 11: A method of producing a bendable nickel phosphorus plating layer on a substrate, wherein the substrate comprises a dielectric substrate with copper plating thereon, the method comprising the steps of:

a. activating the substrate with a palladium activation solution to catalyze the substrate, and thereafter b. contacting the activated substrate with an electroless nickel phosphorus plating solution comprising:

i. a source of nickel ions;

ii. a source of hypophosphite ions;

iii. at least one complexing agent;

iv. a flex additive, wherein the flex additive comprises a compound represented by the following general structure:

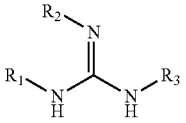

wherein $R_2$=H and $R_3$=H, methyl, ethyl, propyl, isopropyl $R_1$=$NH_2$, COOH, CN, OH,

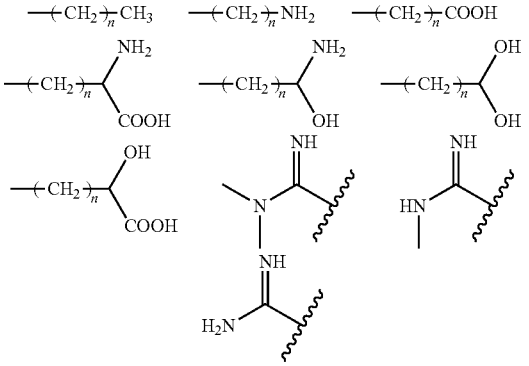

where n=1-7.

v. optionally a pH adjuster; and vi. optionally, a source of lead ions;

vii. optionally, stabilizer;

wherein the bendable nickel phosphorus plating layer deposited on the substrate exhibits a columnar grain structure.

Clause 12: The method according to clause 11, wherein the source of nickel ions in the electroless nickel phosphorus plating solution is selected from the group consisting of nickel chloride, nickel sulfate, nickel acetate, nickel nitrate, and combinations of the foregoing.

Clause 13: The method according to clause 11 or clause 12, wherein the at least one complexing agent comprises a carboxylic acid, a substituted carboxylic acid, an unsaturated carboxylic acid or a combination of the foregoing.

Clause 14: The electroless nickel phosphorus plating bath according to clause 13, wherein the carboxylic acid, substituted carboxylic acid or unsaturated carboxylic acid comprise at least one of a monocarboxylic acid, a dicarboxylic acid, a tricarboxylic acid, an aminocarboxylic acid, a hydroxycarboxylic acid, and combinations thereof.

Clause 15: The method according to clause 13 or clause 14, wherein at least one of the at least one complexing agent is selected from the group consisting of acetic acid, propionic acid, glycolic acid, lactic acid, pyruvic acid, succinic acid, glutaric acid, itaconic acid, adipic acid, maleic acid, fumaric acid, malic acid, citric acid, aminoacetic acid, 2-aminopropanoic acid, aspartic acid combinations thereof.

Clause 16: The method according to clause 15, wherein the at least one complexing agent comprises lactic acid and one or more of succinic acid, adipic acid, glutaric acid, fumaric acid, itaconic acid, and combinations thereof.

Clause 17: The method according to any of clauses 11-16, wherein the organic flex additive comprises a guanidine derivative.

Clause 18: The method according to any of clauses 11-17, wherein the electroless nickel phosphorus plating bath is at least substantially free of formaldehyde and formaldehyde precursors.

Clause 19: The method according to any of clauses 11-18, wherein the electroless nickel phosphorus plating bath is at least substantially free of a hydroxycarboxylic acid complexing agent.

Clause 20: The method according to any of clauses 11-19, wherein the electroless nickel phosphorus plating bath includes at least one of a buffer and a wetting agent.

Clause 21: The method according to any of clauses 11-20, wherein the electroless nickel phosphorus plating bath includes one more additional alloying metals, wherein the one or more additional alloying metals are selected from the group consisting of tungsten, tin, iron, cobalt, chromium, cobalt, manganese, and combinations of the foregoing.

Clause 22: The method according to any of clauses 11-21, further comprising the step of depositing an immersion gold layer over the flexible nickel phosphorus alloy layer or depositing an electroless palladium and an immersion gold layer over the flexible nickel phosphorus alloy layer.

Clause 23: A substrate having a bendable nickel phosphorus alloy plating layer thereon made by the method of any of clauses 11-22.

Clause 24: The substrate according to clause 23, wherein the substrate comprises a copper layer on a dielectric material.

Clause 25: The substrate according to clause 24, wherein the dielectric material is a polyimide.

What is claimed is:

1. An electroless nickel phosphorus plating bath comprising:

a. a source of nickel ions, wherein the source of nickel ions is selected from the group consisting of nickel chloride, nickel sulfate, nickel acetate, nickel nitrate, and combinations of the foregoing;

b. a source of hypophosphite ions;

c. at least one complexing agent;

d. a flex additive, wherein the flex additive comprises a guanidine derivative selected from the group consisting of aminoguanidine, (1-amino-4-guanidinobutane sulfate salt), 3-guanidinopropionic acid, 1-cyanoguanidine, 2-amino-5-guanidinopentanoic acid, (1.1-dimethylbiguanide hydrochloride, and combinations of one or more of the foregoing;

e. optionally, a pH adjuster;

f. optionally, a bath stabilizer; and g. optionally, a source of lead ions;

wherein the electroless nickel phosphorus plating bath is configured to deposit a nickel-phosphorus plating layer on a substrate having a columnar grain structure;

wherein the electroless nickel phosphorus plating bath is at least substantially free of any ingredient that would prevent the electroless nickel phosphorus plating bath from producing the nickel phosphorus plating having the columnar grain structure.

2. The electroless nickel phosphorus plating bath according to claim 1, wherein the electroless nickel phosphorus plating bath is at least substantially free of formaldehyde and formaldehyde precursors.

3. The electroless nickel phosphorus plating bath according to claim 1, wherein the electroless nickel phosphorus plating bath includes at least one of a buffer and a wetting agent.

4. The electroless nickel phosphorus plating bath according to claim 1, wherein the electroless nickel phosphorus plating bath includes one more additional alloying metals, wherein the one or more additional alloying metals are selected from the group consisting of tungsten, tin, iron, cobalt, chromium, cobalt, manganese, and combinations of the foregoing.

5. The electroless nickel phosphorus plating bath according to claim 1, wherein the electroless nickel phosphorus plating bath composition is maintained at a pH within the range of about 3 to about 6.

6. The electroless nickel phosphorus plating bath according to claim 1, wherein the at least one complexing agent comprises a carboxylic acid, a substituted carboxylic acid, an unsaturated carboxylic acid or a combination of the foregoing.

7. The electroless nickel phosphorus plating bath according to claim 6, wherein the carboxylic acid, substituted carboxylic acid or unsaturated carboxylic acid comprise at least one of a monocarboxylic acid, a dicarboxylic acid, a tricarboxylic acid, an aminocarboxylic acid, a hydroxycarboxylic acid, or combinations thereof.

8. The electroless nickel phosphorus plating bath according to claim 6, wherein at least one of the at least one complexing agent is selected from the group consisting of acetic acid, propionic acid, glycolic acid, lactic acid, pyruvic acid, succinic acid, glutaric acid, itaconic acid, adipic acid, maleic acid, fumaric acid, malic acid, citric acid, aminoacetic acid, 2-aminopropanoic acid, aspartic acid combinations thereof.

9. The electroless nickel phosphorus plating bath according to claim 6, wherein the at least one complexing agent comprises lactic acid and one or more of succinic acid, adipic acid, glutaric acid, fumaric acid, itaconic acid, and combinations thereof.

10. A method of producing a bendable nickel phosphorus plating layer on a substrate, wherein the substrate comprises a dielectric substrate with copper plating thereon, the method comprising the steps of:

a. activating the substrate with a palladium activation solution to catalyze the substrate, and thereafter b. contacting the activated substrate with an electroless nickel phosphorus plating solution comprising:

i. a source of nickel ions, wherein the source of nickel ions is selected from the group consisting of nickel chloride, nickel sulfate, nickel acetate, nickel nitrate, and combinations of the foregoing;

ii. a source of hypophosphite ions;

iii. at least one complexing agent;

iv. a flex additive, wherein the flex additive comprises a guanidine derivative selected from the group consisting of aminoguanidine, (1-amino-4-guanidinobutane sulfate salt), 3-guanidinopropionic acid, 1-cyanoguanidine, 2-amino-5-guanidinopentanoic acid, (1,1-dimethylbiguanide hydrochloride, and combinations of one or more of the foregoing;

v. optionally a pH adjuster; and vi. optionally, a source of lead ions;

vii. optionally, stabilizer;

wherein the bendable nickel phosphorus plating layer deposited on the substrate exhibits a columnar grain structure.

11. The method according to claim 10, wherein the at least one complexing agent comprises a carboxylic acid, a substituted carboxylic acid, an unsaturated carboxylic acid or a combination of the foregoing.

12. The electroless nickel phosphorus plating bath according to claim 11, wherein the carboxylic acid, substituted carboxylic acid or unsaturated carboxylic acid comprise at least one of a monocarboxylic acid, a dicarboxylic acid, a tricarboxylic acid, an aminocarboxylic acid, a hydroxycarboxylic acid, and combinations thereof.

13. The method according to claim 11, wherein at least one of the at least one complexing agent is selected from the group consisting of acetic acid, propionic acid, glycolic acid, lactic acid, pyruvic acid, succinic acid, glutaric acid, itaconic acid, adipic acid, maleic acid, fumaric acid, malic acid, citric acid, aminoacetic acid, 2-aminopropanoic acid, aspartic acid combinations thereof.

14. The method according to claim 12, wherein the at least one complexing agent comprises lactic acid and one or more of succinic acid, adipic acid, glutaric acid, fumaric acid, itaconic acid, and combinations thereof.

15. The method according to claim 10, wherein the electroless nickel phosphorus plating bath is at least substantially free of formaldehyde and formaldehyde precursors.

16. The method according to claim 10, wherein the electroless nickel phosphorus plating bath is at least substantially free of a hydroxycarboxylic acid complexing agent.

17. The method according to claim 10, wherein the electroless nickel phosphorus plating bath includes at least one of a buffer and a wetting agent.

18. The method according to claim 10, wherein the electroless nickel phosphorus plating bath includes one more additional alloying metals, wherein the one or more additional alloying metals are selected from the group consisting of tungsten, tin, iron, cobalt, chromium, cobalt, manganese, and combinations of the foregoing.

19. The method according to claim 10, further comprising the step of depositing an immersion gold layer over the flexible nickel phosphorus alloy layer.

20. The method according to claim 10, further comprising the step of depositing an electroless palladium and an immersion gold layer over the flexible nickel phosphorus alloy layer.

21. A substrate having a bendable nickel phosphorus alloy plating layer thereon made by the method of claim 10.

22. The substrate according to claim 21, wherein the substrate comprises a copper layer on a dielectric material.

23. The substrate according to claim 22, wherein the dielectric material is a polyimide.

* * * * *